US008413448B2

(12) United States Patent
Hicks et al.

(10) Patent No.: US 8,413,448 B2
(45) Date of Patent: Apr. 9, 2013

(54) AIR BLAST FUEL INJECTOR

(75) Inventors: Robert A. Hicks, Derby (GB); Paul Madden, Derby (GB)

(73) Assignee: Rolls-Royce PLC, London (GB)

( * ) Notice: Subject to any disclaimer, the term of this patent is extended or adjusted under 35 U.S.C. 154(b) by 462 days.

(21) Appl. No.: 12/844,201

(22) Filed: Jul. 27, 2010

(65) Prior Publication Data

US 2011/0072825 A1 Mar. 31, 2011

(30) Foreign Application Priority Data

Sep. 28, 2009 (GB) ..... 0916944.2

(51) Int. Cl.
*F02C 3/00* (2006.01)
*F23R 3/14* (2006.01)
*F23R 3/30* (2006.01)

(52) U.S. Cl.
USPC ..... 60/748; 60/743

(58) Field of Classification Search ..... 60/748, 60/740, 743; 239/400, 403–406
See application file for complete search history.

(56) References Cited

U.S. PATENT DOCUMENTS 5,737,921 A * 4/1998 Jones et al. ..... 60/748
7,658,075 B2 * 2/2010 von der Bank ..... 60/748
2010/0307161 A1 * 12/2010 Thomson et al. ..... 60/748

FOREIGN PATENT DOCUMENTS

GB 2460943 A 12/2009
WO WO 2009/039142 A2 3/2009

OTHER PUBLICATIONS

Great Britain Search Report issued in Great Britain Application No. 0916944.2 dated Dec. 23, 2009.

* cited by examiner

*Primary Examiner* — Ted Kim
(74) *Attorney, Agent, or Firm* — Oliff & Berridge, PLC

(57) ABSTRACT

An airblast fuel injector for the combustor of a gas turbine engine has, in order from radially inner to outer, a coaxial arrangement of an inner swirler passage, an annular fuel passage, an annular mid swirler passage, and an annular outer swirler passage. The fuel passage extends to a prefilming lip, and the inner and mid swirler passages swirl air past the prefilming lip so that fuel fed from the fuel passage to the prefilming lip is entrained by the swirling air into a fuel spray stream. The outer swirler passage has a convergent portion. The radially inward wall of said convergent portion is defined by a frustoconical separator element which separates the outer swirler passage from the mid swirler passage, the separator element converging in the direction of air flow to terminate in a lip at the mouths of the mid swirler passage and the outer swirler passage.

12 Claims, 2 Drawing Sheets

AIR BLAST FUEL INJECTOR

FIELD OF THE INVENTION

The present invention relates to an airblast fuel injector for a gas turbine.

BACKGROUND OF THE INVENTION

Fuel injection systems deliver fuel to the combustion chamber of an engine, where the fuel is thoroughly mixed with air before combustion. One form of fuel injection system well-known in the art is a fuel spray nozzle. Fuel spray nozzles atomise the fuel to ensure its rapid evaporation and burning when mixed with air.

An airblast atomiser nozzle is a type of fuel spray nozzle in which fuel delivered to the combustion chamber by a fuel injector is aerated by swirlers to ensure rapid mixing of fuel and air, and to create a finely atomised fuel spray. The swirlers impart a swirling motion to air entering the combustion chamber, so as to create a high level of shear in the fuel flow.

Typically, an airblast atomiser nozzle will have a number of swirlers. An annular fuel passage between a pair of swirlers feeds fuel onto a prefilming lip. Thus a sheet of fuel is formed that breaks down into ligaments. These ligaments are then broken up into droplets within the shear layers of the surrounding highly swirling air, to form the fuel spray stream that is emitted from the fuel injection system.

Combustion noise in a gas turbine combustor is encountered when the fluctuating heat release occurring within the combustor is in phase with the resonant frequency of the combustor cavity. The resulting fluctuating pressure can lead to unacceptably high levels of audible noise and deterioration of component life through excessive cyclic loading. It is thought that poor aerodynamic flow within the fuel injector (resulting in local flow instabilities and recirculations within the injector) is linked to the occurrence of combustion noise.

Typically, two frequency ranges of combustion noise are encountered: one is termed Low Frequency Rumble (LFR) and occurs at frequencies in the range of 70-170 Hz, whilst the second form is called High Frequency Rumble (HFR) and typically occurs in the frequency range of 400-600 Hz. Generally, combustion noise is encountered during some transient engine manoeuvres or over a limited range of engine steady state operation. Therefore, an option to combat combustion noise is to vary the fuel supply schedule so that regions within the engine's operating envelope where combustion noise is encountered are either not entered, or, as combustion noise is known to be closely linked to the richness of the air fuel ratio within the combustor, are traversed with reduced fuel flow. For example, decreasing the air-fuel ratio of a fuel injector can be an effective way of preventing particularly LFR. Alternatively, devices such as Helmholtz resonators and passive dampers can be attached to the combustor cavity to damp the amplitude of the fluctuating pressure component.

However, aircraft operability requirements generally dictate the operation mode of the engine. Thus altering the fuel schedule such that the engine operates away from or at reduced fuel flow at a point associated with combustion noise is seldom a viable option. The attachment of resonator or damping devices to a combustor can be effective in attenuating combustion noise. However, such devices have to be durable enough to survive the combustor operating environment, and their inclusion adds weight and cost to the engine. Further, the inclusion of such devices can be hindered by space restrictions on the combustor wall due to the presence of air admission ports. Also, resonators are narrow band devices and their effectiveness can be compromised if the combustion noise does not coincide with an anticipated frequency range. Although enriching the fuel injector has been shown to be effective for combating LFR, it has proved less effective in combating HFR and can result in high levels of smoke. Accordingly, there is a continuing need to develop fuel injection systems to combat combustion noise.

SUMMARY OF THE INVENTION

Thus, according to a first aspect of the invention, there is provided an airblast fuel injector for the combustor of a gas turbine engine, the injector having, in order from radially inner to outer, a coaxial arrangement of an inner swirler passage, an annular fuel passage, an annular mid swirler passage, and an outer annular swirler passage, the fuel passage extending to a prefilming lip, and the inner and mid swirler passages swirling air past the prefilming lip so that fuel fed from the fuel passage to the prefilming lip is entrained by the swirling air into a fuel spray stream which emanates from the prefilming lip, and the outer swirler passage, which swirls further air past the mid swirler passage to modify the fuel spray stream, having a convergent portion which converges in the direction of air flow;

wherein:

the radially inward wall of said convergent portion is defined by a frustoconical separator element which separates the outer swirler passage from the mid swirler passage, the separator element converging in the direction of air flow to terminate in a lip at the mouths of the mid swirler passage and the outer swirler passage, the radially outward wall of said convergent portion is defined by a shroud which converges in the direction of air flow to a shroud lip at the position of maximum convergence of the shroud, the shroud lip having a diameter D* and being downstream of the separator element lip by an axial distance L, and the ratio L/D* being in the range from 0.02 to 0.11, and the shroud depth d is the radial distance between the radially outward wall of the outer swirler passage at the entrance to said convergent portion and the shroud lip, and the outer swirler diameter D is the distance between diametrically opposing midspan positions of the outer swirler passage at the entrance to said convergent portion, the ratio D/d being in the range from 4.5 to 6.5.

Relative to known airblast fuel injectors, the airblast fuel injector of the present invention combines a relatively low L/D* ratio with a relatively high D/d ratio. Advantageously, this has been found to produce flow conditions which can suppress HFR while leaving other injector characteristics (such as effective flow areas and swirl angles) unchanged such that combustor operability is not significantly affected.

The injector may have any one or any combination of the following optional features.

The axial distance L may be in the range from 1 to 2 mm.

The outer swirler passage may provide at least 50% and preferably at least 55% of the total air flow of the injector.

The injector typically has an injector body which can be mounted to a mating portion of the combustor, the body comprising the inner swirler passage, the annular fuel passage, the annular mid swirler passage, and the annular outer swirler passage. Thus the injector body typically comprises the shroud and other features of the injector which are radially inwards thereof.

However, alternatively, the injector may have an injector body comprising at least the inner swirler passage, the annular fuel passage, and the annular mid swirler passage, and the injector may be formed by mounting the injector body into a mating portion of the combustor, the mating portion comprising at least the shroud. For example, the separator element can have a radially inner portion which is a part of the injector body, and a radially outer portion which is a part of the mating portion of the combustor. The outer swirler passage can thus be provided by the combustor.

Indeed, a second aspect of the invention provides a combustor of a gas turbine engine, the combustor having a mating portion for mounting an injector body comprising at least the inner swirler passage, the annular fuel passage, and the annular mid swirler passage of the injector of the first aspect, wherein the mating portion comprises at least the shroud of the injector of the first aspect.

BRIEF DESCRIPTION OF THE DRAWINGS

Embodiments of the invention will now be described by way of example with reference to the accompanying drawings in which.

DETAILED DESCRIPTION

It is believed that the presence of local flow instabilities and separations within a fuel injector play a role in promoting combustion noise. In addition, flow issuing from high swirl fuel injectors have a precessing vortex core which is inherently unstable due to the circulation associated with such flow.

Figure 1:
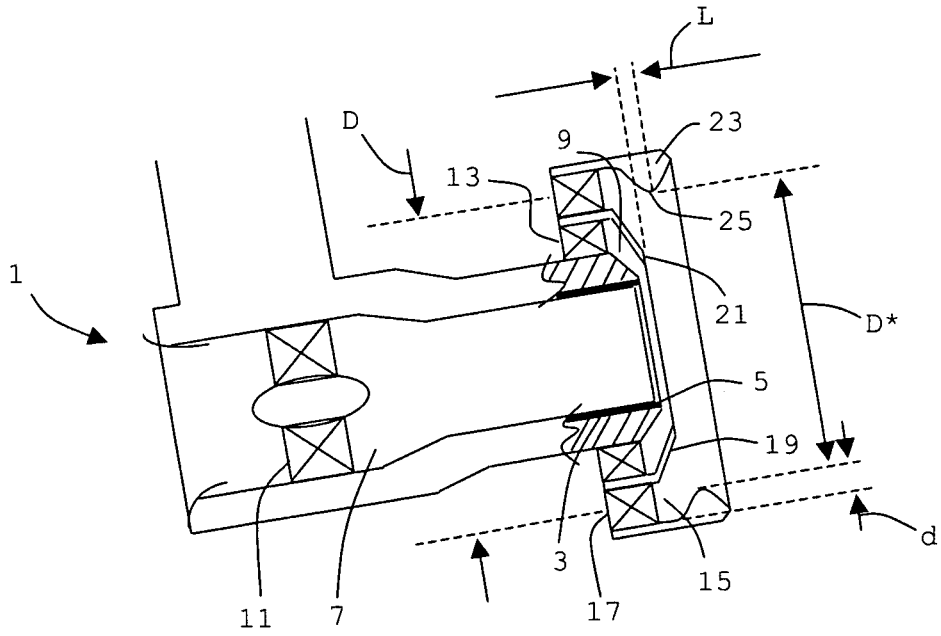
FIG. 1 shows a longitudinal cross-section through a rich burn fuel injector.

FIG. 1 shows a longitudinal cross-section through a fuel injector 1. An annular fuel passage 3 extends in the axial direction of the injector to a prefilming lip 5. Radially inwardly and outwardly of the fuel passage are respectively inner 7 and mid 9 coaxial swirler passages.

The fuel passage 3 feeds fuel to the prefilming lip 5. Air flowing through the inner 7 and mid 9 swirler passages is caused to swirl by respective vanes 11, 13 in the passages. The swirling air flow entrains the fuel on the prefilming lip into a fuel spray, the fuel being finely atomised by the high level of shear in the flow. With distance from the prefilming lip, the fuel spray expands outwardly in a cone. The fuel passage and inner and mid swirler passages are configured to produce a cone angle of about 90° and a well-atomised fuel spray.

The injector also has a coaxial annular outer (or "dome") swirler passage 15 radially outward of the mid swirler passage 9. Air flowing through the outer swirler passage is caused to swirl by vanes 17 to produce a further swirling air flow which assists generation of a wider fuel spray cone angle of about 180°, the wider cone angle helping to raise combustion efficiency. To augment this function, the outer swirler passage has a convergent portion. The inner wall of this convergent portion is defined by a frustoconical separator element 19 which separates the outer swirler passage from the mid swirler passage 9 and which converges in the direction of air flow to terminate in a conic lip 21 at the mouths of the mid swirler passage and the outer swirler passage. The outer wall of the convergent portion is defined by a shroud 23 (or "deflector") located downstream of the vanes 17. The shroud converges in the direction of air flow to a shroud lip 25 at the position of maximum convergence of the shroud.

The further air flow from the outer swirler passage deflects all the swirling air flows radially inwards, producing an increase in tangential velocity which aids rapid radial expansion of the flow downstream of the injector exit. Furthermore, the in-turning caused by the convergent portion of the shroud allows flow to reach "gas wash" surfaces within the injector (ie at the conic lip 21) to aid cooling. It also helps to promote interaction between the various flow streams issuing from the swirlers. In the fuel injector 1 shown in FIG. 1, the ratio L/D* is about 0.05, where D* is the diameter of the shroud lip 25, and L is the axial distance by which the shroud lip is downstream from the conic lip 21. L is typically about 1 mm. Further, the ratio Did is about 10, where D is the distance between diametrically opposing midspan positions of the outer swirler passage 15 at the entrance to the convergent portion, and d is shroud depth (ie the radial distance between the radially outward wall of the outer swirler passage at the entrance to the convergent portion and the shroud lip).

Figure 2:
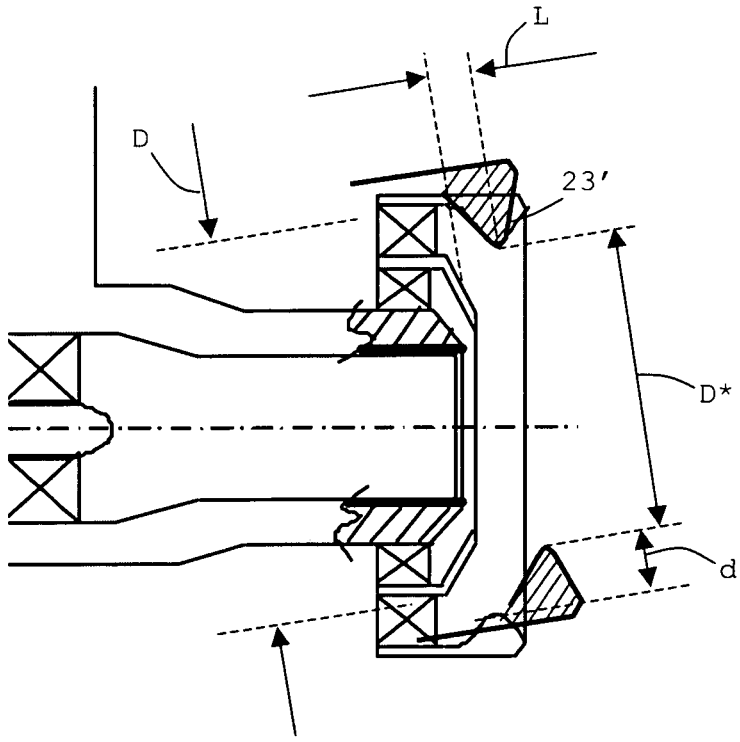
FIG. 2 which is a closer view of the exit region of the fuel injector of FIG. 1, a schematic of a deeper shroud being superimposed over the original shroud of the injector.

CFD analysis suggests that the flow with the injector 1 can be susceptible to separation, as the flow experiences a radial pressure gradient associated with expansion around the lip 25 of the shroud. The presence of flow instabilities associated with flow separation has the potential to promote combustion noise. However, the tendency for separation can be suppressed by an increase in pressure drop. This can be achieved by the introduction of a deeper shroud, as shown in FIG. 2 which is a closer view of the exit region of the fuel injector of FIG. 1, a schematic of the deeper shroud 23' being superimposed over the original shroud. The deeper shroud results in the ratio L/D* being in the range from 0.02 to 0.11, and the ratio Did being in the range from 4.5 to 6.5. L can be, for example, in the range from 1 to 2 mm.

The deeper shroud 23' causes a greater radial inward deflection and hence greater acceleration of the swirling air flows, suppressing the tendency for flow separation. In addition, the deeper shroud brings other benefits, which have the potential to reduce combustion noise.

For example, the greater inwards radial deflection can force a stronger interaction between the swirling air flows, resulting in a more uniform mixture distribution which can aid combustion noise suppression through a reduction in heat release variance. The magnitude of the precession variation experienced by the flow on exiting the fuel injector can also be reduced by the presence of the deeper shroud 23' due to the smaller diameter D* of the exit orifice. Further, the deeper shroud can lead to a faster reattachment of the flow to the downstream face of the shroud. This arises because the increase in angular momentum caused by the exaggerated flow in-turning results in a faster and greater expansion of the flow. Thus, the resulting fuel spray cone angle tends to increase with the deeper shroud, quickening flow reattachment which in turn can have a stabilising influence on the cone.

Figure 3:
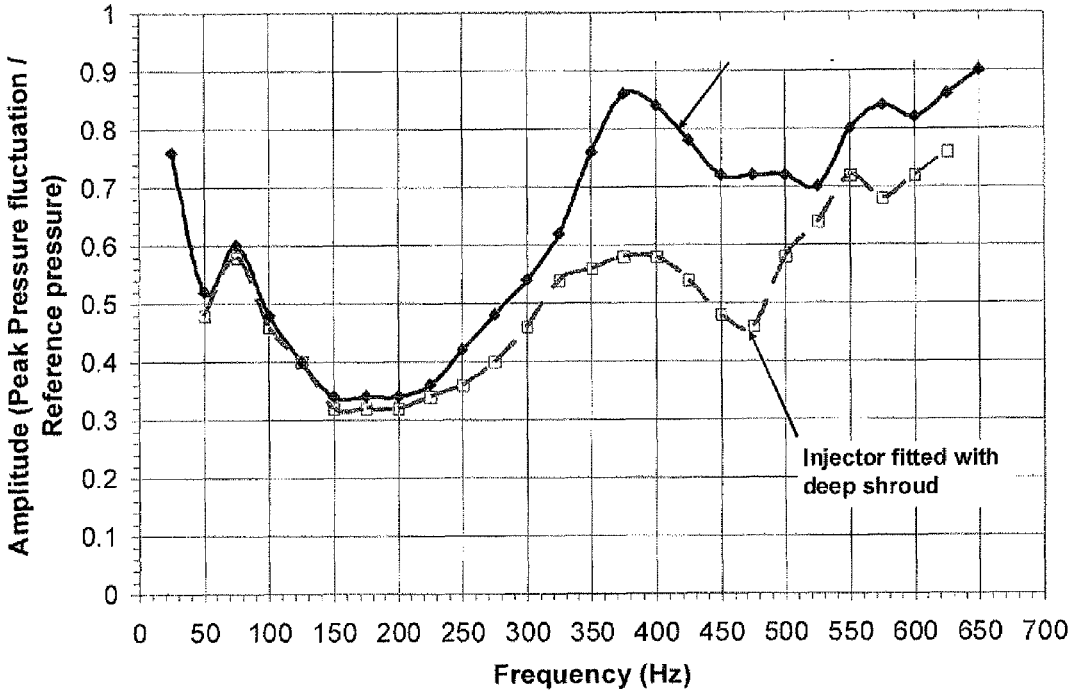
FIG. 3 shows plots of measured noise amplitude against frequency for injectors with and without a deeper shroud.

The inclusion of a deeper shroud on an injector was investigated via rig testing. FIG. 3 shows plots of measured noise amplitude against frequency for injectors with and without the deeper shroud. The deeper shroud was effective at attenuating combustion noise, particularly in the 300 to 600 Hz region.

The inclusion of the deeper shroud on the fuel injector also led to a 45% reduction in the amplitude of a flame's response to pressure waves recorded in a combustor. As flame response is part of the thermoacoustic cycle which creates combustion noise, this correlates with the measured reduction in combustion noise.

Advantages which can be achieved with the deeper shroud are:

1 Reduced likelihood of flow separation.

2 A stronger mixing interaction between the swirler air flows, resulting in a more uniform mixture distribution.

3 Reduced magnitude of precession variation of the vortex core.

4 Faster reattachment of the flow to the downstream face of the shroud.

Furthermore, the modified shroud geometry, while reducing the propensity of the injector to initiate and sustain combustion noise by reducing the response of the flame to rumble frequencies, allows important injector features (eg effective flow area, swirl angles) to be substantially unchanged such that combustor operability is not affected.

The improved level of interaction between the swirler flow streams achieved with the deep shroud also has the potential to benefit emissions through the provision of a more uniform mixture exiting the fuel injector.

Although shown and tested using an injector design that incorporates the outer swirler within the body of the injector itself, it would also be applicable to the situation where the outer swirler is, for example, incorporated into the head of the combustor.

It is also expected that the modified shroud geometry will provide beneficial effects with other injector designs, for example, injectors in which the fuel passage and inner and mid swirler passages produce larger spray cone angles of e.g. about 130°.

While the invention has been described in conjunction with the exemplary embodiments described above, many equivalent modifications and variations will be apparent to those skilled in the art when given this disclosure. Accordingly, the exemplary embodiments of the invention set forth above are considered to be illustrative and not limiting.

The invention claimed is:

1. An airblast fuel injector for the combustor of a gas turbine engine, the injector having, in order from radially inner to outer, a coaxial arrangement of an inner swirler passage, an annular fuel passage, an annular mid swirler passage, and an annular outer swirler passage, the fuel passage extending to a prefilming lip, and the inner and mid swirler passages swirling air past the prefilming lip so that fuel fed from the fuel passage to the prefilming lip is entrained by the swirling air into a fuel spray stream which emanates from the prefilming lip, and the outer swirler passage, which swirls further air past the mid swirler passage to modify the fuel spray stream, having a convergent portion which converges in the direction of air flow;

wherein:

the radially inward wall of said convergent portion is defined by a frustoconical separator element which separates the outer swirler passage from the mid swirler passage, the separator element converging in the direction of air flow to terminate in a lip at the mouths of the mid swirler passage and the outer swirler passage, the radially outward wall of said convergent portion is defined by a shroud which converges in the direction of air flow to a shroud lip at the position of maximum convergence of the shroud, the shroud lip having a diameter D* and being downstream of the separator element lip by an axial distance L, and the ratio L/D* being in the range from 0.02 to 0.11, and the shroud depth d is the radial distance between the radially outward wall of the outer swirler passage at the entrance to said convergent portion and the shroud lip, and the outer swirler diameter D is the distance between diametrically opposing midspan positions of the outer swirler passage at the entrance to said convergent portion, the ratio Did being in the range from 4.5 to 6.5.

2. An airblast fuel injector according to claim 1, wherein L is in the range from 1 to 2 mm.

3. An airblast fuel injector according to claim 2, wherein the outer swirler passage provides at least 50% of the total air flow of the injector.

4. An airblast fuel injector according to claim 3, which is formed by mounting an injector body comprising at least the inner swirler passage, the annular fuel passage, and the annular mid swirler passage to a mating portion of the combustor, the mating part portion comprising at least the shroud.

5. A combustor comprising the airblast fuel injector of claim 4.

6. An airblast fuel injector according to claim 2, which is formed by mounting an injector body comprising at least the inner swirler passage, the annular fuel passage, and the annular mid swirler passage to a mating portion of the combustor, the mating part portion comprising at least the shroud.

7. An airblast fuel injector according to claim 1, wherein the outer swirler passage provides at least 50% of the total air flow of the injector.

8. A combustor comprising the airblast fuel injector of claim 6.

9. An airblast fuel injector according to claim 7, which is formed by mounting an injector body comprising at least the inner swirler passage, the annular fuel passage, and the annular mid swirler passage to a mating portion of the combustor, the mating part portion comprising at least the shroud.

10. A combustor comprising the airblast fuel injector of claim 9.

11. An airblast fuel injector according to claim 1, which is formed by mounting an injector body comprising at least the inner swirler passage, the annular fuel passage, and the annular mid swirler passage to a mating portion of the combustor, the mating part portion comprising at least the shroud.

12. A combustor comprising the airblast fuel injector of claim 11.

* * * * *